United States Patent [19]

Watmough

[11] 4,205,981

[45] Jun. 3, 1980

[54] METHOD FOR LADLE TREATMENT OF MOLTEN CAST IRON USING SHEATHED MAGNESIUM WIRE

[75] Inventor: Thomas Watmough, Flossmoor, Ill.

[73] Assignee: International Harvester Company, Chicago, Ill.

[21] Appl. No.: 16,221

[22] Filed: Feb. 28, 1979

[51] Int. Cl.[2] ..... C21C 7/02

[52] U.S. Cl. ..... 75/58; 75/33; 75/129; 75/130 R; 75/130 B

[58] Field of Search ..... 75/53, 129, 130 R, 58, 75/130 B

[56] References Cited

U.S. PATENT DOCUMENTS

| | | | |
|---|---|---|---|
| 3,056,190 | 10/1962 | Chisholm | 75/130 R |
| 3,634,075 | 1/1972 | Hoff | 75/129 |
| 3,728,109 | 4/1973 | Okubo | 75/129 |
| 3,729,309 | 4/1973 | Kawawa | 75/129 |
| 3,768,999 | 10/1973 | Okubo | 75/129 |
| 4,057,420 | 11/1977 | Brace | 75/130 R |
| 4,108,637 | 8/1978 | Hetke | 75/130 R |

*Primary Examiner*—P. D. Rosenberg

*Attorney, Agent, or Firm*—John P. O'Brien; F. David AuBuchon

[57] ABSTRACT

An improved method for nodularizing molten cast iron contained in a ladle by delivering a sheathed magnesium or magnesium alloy wire beneath the surface of the molten cast iron such that the melting and vaporization of the magnesium occurs beneath the surface of the molten cast iron.

10 Claims, No Drawings

METHOD FOR LADLE TREATMENT OF MOLTEN CAST IRON USING SHEATHED MAGNESIUM WIRE

BACKGROUND OF THE INVENTION

An essential step in the commercial production of nodular cast iron is the addition of magnesium to the molten cast iron. The magnesium acts as the nodularizing agent which insures the graphite is precipitated as discrete spheroidal particles in the matrix. The difficulty in adding magnesium to a bath of molten cast iron at 2700° F., is that the magnesium melts at 1200° F., boils at 2200° F., and has a high vapor pressure.

There have been many techniques developed in the past to economically alloy molten cast iron with the volatile, highly reactive magnesium. One reason there are so many prior art processes is that the environment in which the magnesium is added to the molten cast iron directly controls the type of method for introducing additives into the molten cast iron. For example the following series of U.S. patent assigned to the Caterpillar Tractor Company for introducing additives to a casting mold containing molten cast iron would not be applicable to treating molten metal in a ladle: U.S. Pat. Nos. 3,921,700; 3,991,808; 3,991,810; and 4,040,468. The reason that a process for introducing magnesium additives into a casting mold would not work in a ladle containing molten metals is that there are many different variables to consider when comparing the two types of processes, such as: the volume of molten metal, the quantity of magnesium additive, the treatment time, etc.

This invention relates to the commercial production of nodular cast iron by the addition of magnesium to molten cast iron in a ladle. Many ladle methods treatments have been revised for adding magnesium to molten cast iron. The following three described methods are representative of such prior art ladle processes.

In U.S. Pat. No. 2,577,837 to Zifferer, there is disclosed the technique for introducing magnesium wire beneath the surface of a molten cast iron through a pressurized submerged refactory tube. This process has the obvious disadvantage that a pressurized submerged refactory tube must be employed which is both cumbersome to work with and expensive to use.

The second prior art ladle process is disclosed in U.S. Pat. No. 3,768,999 to Ohkubo et al. This patent discloses coating a wire with additive components and an organic binder which thermally decomposes to a gaseous product when added to the molten metal. Obviously it is expensive to construct such a coated wire which prohibitively increases the cost of the treatment process.

A third prior art process is disclosed in the May, 1975 issue of the publication *Modern Castings*, in an article entitled "The Use of Magnesium Wire Injection for the Production of Nodular Iron" by M. C. Ashton et al. This article discloses the injection of magnesium wire through the bottom wall of a specially constructed ladle. In order to keep the hole through which the wire is fed up into the molten metal it is necessary to maintain a high gas pressure stream through the bottom of the ladle. This utilization of the gas stream has the further disadvantage of producing excessive agitation of the molten iron which contributes to excessive heat losses.

SUMMARY OF THE INVENTION

A process for adding a relatively volatile metallic agent to a ladle containing a molten ferrous metal at a temperature higher then the boiling temperature of the volatile metallic agent comprising the steps of enclosing a wire made of the volatile metallic agent with a ferrous metal sheath having a wall thickness of at least 0.040 inches and feeding this sheathed wire at a speed greater than 60 feet per minute into the ladle beneath the surface of the molten ferrous metal to cause the melting and vaporization of the volatile metallic agent beneath the surface of the molten ferrous metal.

DESCRIPTION OF THE PREFERRED EMBODIMENT

In practicing the principles of this invention the following apparatus is used. A spool of sheathed magnesium or magnesium alloy wire is placed on a spindle. The end of the spool is fed through a pair of drive rolls which when activated, propel the sheathed magnesium or magnesium alloy wire at a selected speed into a ladle of molten cast iron which is positioned under the drive rolls. A commercially available drive mechanism is employed for operating the pair of drive rolls to deliver the sheathed wire into the ladle at speed up to 400 feet per minute.

The purpose of adding a sheath around the magnesium or magnesium alloy wire is to insure that the magnesium will not be exposed to the molten cast iron until it is well below the upper surface of the molten cast iron. The sheath material can be any metal that is compatible with the molten cast iron and which has a melting point much higher than that of magnesium (1200° F.) but less than the temperature of the bath of molten cast iron (2700° F.). A suitable material for the sheathing cover is steel, which has all the characteristics mentioned above.

Experiments have revealed that the speed at which the wire is added to the ladle and the thickness of the sheathing cover are both critical to successfully practicing this invention. To insure uniform dispersion of the magnesium in the ladle and to insure that the dispersion of magnesium commences well below the surface of the molten cast iron, it has been discovered that the wire rod must be added at a velocity in excess of 60 feet per minute and that the metal sheath has a wall thickness of at least 0.040 inches. When introducing a sheathed magnesium wire at speeds greater than 60 feet per minute and with the wall thickness of the sheath being in excess of 0.040 inches, the magnesium will vaporize well below the upper surface of the molten cast iron at a multiplicity of locations throughout the molten cast iron bath to provide great dispersion of the magnesium throughout the molten bath.

As shown in Table I, good recovery of the magnesium is obtained when the sheathing thickness is at least 0.040 inches.

TABLE I

INFLUENCE OF SHEATHING THICKNESS (⅛INCH NOMINAL Mg CORE)

| SHEATHING THICKNESS | FEET ADDED | PERCENT Mg ADDED | PERCENT Mg RECOVERED | PERCENT RECOVERY |
|---|---|---|---|---|
| 0.024 | 500 | 0.179 | 0.020 | 11 |
| 0.033 | 500 | 0.173 | 0.029 | 17 |
| 0.042 | 570 | 0.180 | 0.076 | 42 |

Table II demonstrates that the speed rate ranging from 200 to 350 feet per minute has no substantial effect on the favorable high recovery rate.

TABLE II

INFLUENCE OF FEED RATE ON MAGNESIUM RECOVERY (⅛ INCH NOMINAL Mg CORE AND 0.042 INCH SHEATHING)

| FEET ADDED | FEED RATE FT/MIN. | PERCENT Mg ADDED | PERCENT Mg RECOVERED | PERCENT RECOVERY |
|---|---|---|---|---|
| 259 | 194 | .081 | .039 | 47 |
| 300 | 222 | .091 | .046 | 51 |
| 570 | 285 | .180 | .076 | 42 |
| 570 | 332 | .207 | .100 | 48 |

Favorable high recovery rate is maintained over a wide range of additional percentages can be observed in Table III for a ⅛ inch nominal magnesium core having 0.042 inch steel sheathing. This table shows a recovery range from 42 to 51 percent with an additional 0.21 to 0.08 percent magnesium.

TABLE III

INFLUENCE OF AMOUNT OF MAGNESIUM ADDED ON PERCENT RECOVERY (⅛ INCH NOMINAL Mg CORE AND 0.042 INCH SHEATHING)

| FEET ADDED | PERCENT Mg ADDED | PERCENT Mg RECOVERED | PERCENT RECOVERY |
|---|---|---|---|
| 570 | .207 | .100 | 48 |
| 570 | .180 | .076 | 42 |
| 400 | .100 | .060 | 48 |
| 300 | .091 | .046 | 51 |
| 225 | .104 | .059 | 56 |
| 200 | .092 | .045 | 49 |
| 200 | .092 | .044 | 48 |
| 259 | .081 | .039 | 47 |

The above described wire feeding process embodying the principles of this invention permits the nodulizing of molten cast iron in a one to two minute treatment period to thereby economically produce alloy molten cast iron with volatile, highly reactive magnesium and to obtain consistent recoveries of magnesium and produce good quality nodular cast iron.

Another important application of the magnesium wire treatment method described above is desulphurizing molten pig iron and cast iron. It is possible to incrementally add magnesium below the surface of the molten cast iron to cause desulphurization by feeding the sheathed magnesium wire into the ladle at a controlled rate of speed.

One of the major advantages of using the wire feeding method over prior art processes is that the footage of wire to be fed is readily adjustable to accommodate both different sizes of treatment and base iron sulphur content. Thus, it is possible to readily reduce the sulphur content to a desired low percentage content by adding a given length of wire.

Table IV demonstrates the desulphurizing effect of adding a given quantity of magnesium to a ladle of molten cast iron.

TABLE IV

COMPARISON OF DESULPHURIZING EFFECT (⅛ INCH NOMINAL Mg CORE AND .042 INCH SHEATHING)

| PERCENT MAGNESIUM | | PERCENT SULPHUR | |
|---|---|---|---|
| ADDED | RECOVERED | BEFORE TREATMENT | ADDED TREATMENT |
| .178 | .069 | .017 | .004 |
| .178 | .071 | .017 | .003 |
| .180 | .076 | .017 | .003 |
| .207 | .100 | .017 | .006 |
| .126 | .060 | .022 | .007 |
| .091 | .046 | .022 | .007 |
| .081 | .039 | .022 | .008 |

It will be appreciated from the foregoing description the wire feed method embodying the principles of this invention is a viable technique for producing nodular iron and has many advantages. Metal treatment costs are significantly lower than conventional practice.

Other advantages of this invention when compared to conventional methods are as follows: quick and simple installation of wire feeding equipment; the footage of the sheathed wire to be fed is readily adjustable to meet different sizes of treatment and base iron sulphur contents; and the fume and violence caused by the magnesium's melting and vaporization is quite low.

What is claimed is:

1. A method of adding a relatively volatile metallic agent to a ladle containing a molten ferrous metal at a temperature higher than the boiling temperature of said agent, comprising the steps of enclosing a continuous solid wire made of said volatile metallic agent with a metal sheath having a wall thickness of at least 0.040 inches and a boiling temperature substantially higher than said boiling temperature of said volatile metallic agent, and feeding said sheathed wire at a speed greater than 60 feet per minute into said ladle below the surface of said molten ferrous metal whereby the melting and vaporization of said volatile metallic agent occurs beneath the surface of the molten ferrous metal.

2. A method as defined in claim 1, wherein said volatile metallic agent is a continuous solid magnesium wire.

3. A method as defined in claim 1, wherein said volatile metallic agent is a continuous solid magnesium alloy wire.

4. A method as defined in claim 1, wherein the feed rate of propelling said sheathed continuous solid wire into said ladle is in the range of 200 to 350 feet per minute.

5. A method of adding a relatively volatile metallic agent to a ladle containing a molten ferrous metal at a temperature higher than the boiling temperature of said agent, comprising the steps of enclosing a continuous solid wire made of a said volatile metallic agent with a ferrous metal sheath having wall thickness of at least 0.040 inches, and feeding said sheathed wire at a speed greater than 60 feet per minute into said ladle below the surface of said molten ferrous metal whereby the melting and vaporization of said metallic agent occurs beneath the surface of the molten ferrous metal.

6. A method as defined in claim 5, wherein the feed rate for feeding said sheathed continuous solid wire into said ladle is in the range of 200 to 350 feet per minute.

7. A method as defined in claim 6, wherein said volatile metallic agent is a continuous solid magnesium wire.

8. A method as defined in claim 7, wherein said wall thickness of said ferrous metal sheath is 0.042 inches.

9. A method of desulphurizing a molten ferrous metal contained in a ladle comprising the steps of enclosing a continuous solid wire made of magnesium with a metal sheath having a wall thickness of at least 0.040 inches and a boiling temperature substantially higher than said boiling temperature of said magnesium agent, and feeding said sheathed wire at a speed greater than 60 feet per minute into said ladle below the surface of said molten ferrous metal whereby the melting and vaporization of said magnesium occurs beneath the surface of the molten ferrous metal.

10. A method as defined in claim 9, wherein the feed rate of propelling said sheathed continuous solid wire into said ladle is in the range of 200 to 350 feet per minute.

* * * * *